US005960715A

United States Patent [19]

Voge et al.

[11] Patent Number: 5,960,715

[45] Date of Patent: Oct. 5, 1999

[54] INK DUCT FOR ROTARY PRINTING PRESSES

[75] Inventors: Michael Voge, Malsch; Bernhard Roskosch, Wiesloch, both of Germany

[73] Assignee: Heidelberger Druckmaschinen AG, Heidelberg, Germany

[21] Appl. No.: 09/198,693

[22] Filed: Nov. 24, 1998

[30] Foreign Application Priority Data

Nov. 24, 1997 [DE] Germany ..... 297 20 791 U

[51] Int. Cl.[6] ..... B41F 31/05; B41F 31/06

[52] U.S. Cl. ..... 101/365

[58] Field of Search ..... 101/365, 363, 101/350.1, 350.2, 350.3, 350.4, 350.5, 350.6, 351.1, 351.2, 351.3, 351.4, 355, 356, 357, 364, 148, 207–210, 157, 169; 118/259, 261, 262; 15/256.51

[56] References Cited

U.S. PATENT DOCUMENTS

| | | | |
|---|---|---|---|
| 4,242,958 | 1/1981 | Jeschke | 101/365 |
| 4,387,648 | 6/1983 | Jeschke et al. | 101/363 |
| 4,596,187 | 6/1986 | Ruger | 101/350 |
| 5,408,929 | 4/1995 | Rodi . | |
| 5,727,463 | 3/1998 | Dreschner et al. . | |

FOREIGN PATENT DOCUMENTS

| | | |
|---|---|---|
| 0 021 002 A1 | 1/1981 | European Pat. Off. . |
| 0 754 551 | 1/1997 | European Pat. Off. . |
| 26 48 098 A1 | 5/1978 | Germany . |
| 43 41 243 A1 | 6/1994 | Germany . |

*Primary Examiner*—J. Reed Fisher
*Attorney, Agent, or Firm*—Herbert L. Lerner; Laurence A. Greenberg

[57] ABSTRACT

An ink duct for rotary printing presses with zone-wide metering elements disposed side by side and adjustable a variable spaced distance from an ink duct cylinder, each of the metering elements having support and metering regions disposed in the axial direction of the ink duct cylinder, the support regions resting independently of one another, under spring pressure, at least indirectly on the ink duct cylinder, and the metering regions extending in a wedgelike manner, the metering elements being swivelably supported and being coverable by an elastic foil secured to the ink duct, comprising support bodies disposed on the metering elements at both sides of the metering regions, the metering regions being cylindrical and being formed on the metering elements, the support bodies having a circumference formed with a flattened contact surface portion by which the support bodies at least indirectly rest, under the spring pressure, on the jacket surface of the ink duct cylinder.

6 Claims, 4 Drawing Sheets

INK DUCT FOR ROTARY PRINTING PRESSES

BACKGROUND OF THE INVENTION

Field of the Invention

The invention relates to an ink duct for rotary printing presses with zone-wide metering elements disposed side by side and adjustable a variable spaced distance from an ink duct cylinder, each of the metering elements having support and metering regions disposed in the axial direction of the ink duct cylinder, the support regions resting independently of one another, under spring pressure, directly or indirectly on the ink duct cylinder, and the metering regions extending in a wedgelike manner, the metering elements being pivotably supported and being coverable by an elastic foil secured to the ink duct.

In a heretofore known construction of this general type of ink duct disclosed in the published German Patent Document DE 26 48 098 C3, zone-wide metering elements are provided which have support and metering regions disposed side by side in the axial direction thereof. Because of the resilient support and hence resilient guides of the metering elements on the ink duct cylinder, any changes and fluctuations in the thickness of the ink film are eliminated. The support regions of the metering elements and the guidance therefor on the ink duct cylinder thus provide the basis or foundation for an adjustment of the metering regions which are reproducible at any time and, thus, for sensitive zonal determination of the ink gap. Differing hydrodynamic forces of the ink, sagging of the ink duct cylinder and of the ink duct, nonconcentric or faulty concentric running of the ink duct cylinder, and other deficiencies or imperfections can accordingly no longer cause any change in the ink film thickness.

SUMMARY OF THE INVENTION

It is accordingly an object of the invention of the instant application to provide an ink duct for rotary printing presses with metering elements covered by an elastic foil or film, the wearing of which is considerably reduced.

With the foregoing and other objects in view, there is provided, in accordance with the invention, an ink duct for rotary printing presses with zone-wide metering elements disposed side by side and adjustable a variable spaced distance from an ink duct cylinder, each of the metering elements having support and metering regions disposed in the axial direction of the ink duct cylinder, the support regions resting independently of one another, under spring pressure, at least indirectly on the ink duct cylinder, and the metering regions extending in a wedgelike manner, the metering elements being swivelably supported and being coverable by an elastic foil secured to the ink duct, comprising support bodies disposed on the metering elements at both sides of the metering regions, the metering regions being cylindrical and being formed on the metering elements, the support bodies having a circumference formed with a flattened contact surface portion by which the support bodies at least indirectly rest, under the spring pressure, on the jacket surface of the ink duct cylinder.

In accordance with another feature of the invention, the ink duct includes an eccentically offset swivel location for the support bodies on the metering elements.

In accordance with a further feature of the invention, the support bodies are embodied as support rings disposed on eccentrically offset journals at both sides of the metering elements.

In accordance with an added feature of the invention, the support bodies have eccentrically offset pins by which they are swivelably supported in eccentrically offset bores formed in the metering elements.

In accordance with an additional feature of the invention, the flattened surface portions on the support bodies have an inner radius r approximately corresponding to the radius of the jacket surface of the ink duct cylinder.

In accordance with a concomitant feature of the invention, the ink duct includes guides for holding the metering elements, the guides being formed as the support bodies and being bifurcated for receiving the metering elements between bifurcated ends thereof, the bifurcated ends being formed with flat surfaces.

Thus, in accordance with the invention, the metering elements have a cylindrical metering region, support bodies are disposed at both sides of the metering regions on the metering elements, and the support bodies have a flat or contact surface on the circumference thereof, by which they rest directly or indirectly, under spring pressure, on the jacket surface of the ink duct cylinder. In this construction, the cylindrical metering region can be pivoted or swiveled to adjust the ink film thickness, without requiring the support bodies secured thereto to follow this pivoting or swiveling motion themselves. Because of the flat surface provided on the support bodies, the latter press against the jacket surface of the ink duct cylinder without following the pivoting motion of the metering elements. The flat surface is so formed that there is areal contact between the support bodies and the ink duct cylinder, so that the contact pressure is reduced and the wear behavior of the foil or film is considerably improved.

In an advantageous embodiment of the invention, the pivot or swivel location of the support bodies on the metering elements is eccentrically offset. A wedgelike course of the metering regions at reduced production cost for the metering elements is thereby attained.

In another advantageous embodiment of the invention, support bodies are formed as support rings, which are disposed at both sides of the metering elements on eccentrically offset pins or journals. In an alternative embodiment, the support bodies have eccentrically offset pins with which they are pivotably or swivelably supported in eccentrically offset bores formed in the metering elements. Both embodiments assure independent pivoting or swiveling of the metering elements and an areal contact of the support bodies with the jacket surface of the ink duct cylinder and the elastic foil or film, respectively.

A further advantageous feature of the invention is that the flattened surfaces on the support bodies have an inner radius that is approximately equivalent to the radius of the jacket surface of the ink duct cylinder. This optimally enlarges the contact area, so that further wear reduction at reduced contact pressure is assured.

In yet another advantageous feature, guides for holding the metering elements are embodied as support bodies and are bifurcated so as to receive the metering elements between the bifurcated ends thereof, which are formed with flat surfaces.

Other features which are considered as characteristic for the invention are set forth in the appended claims.

Although the invention is illustrated and described herein as embodied in an ink duct for rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
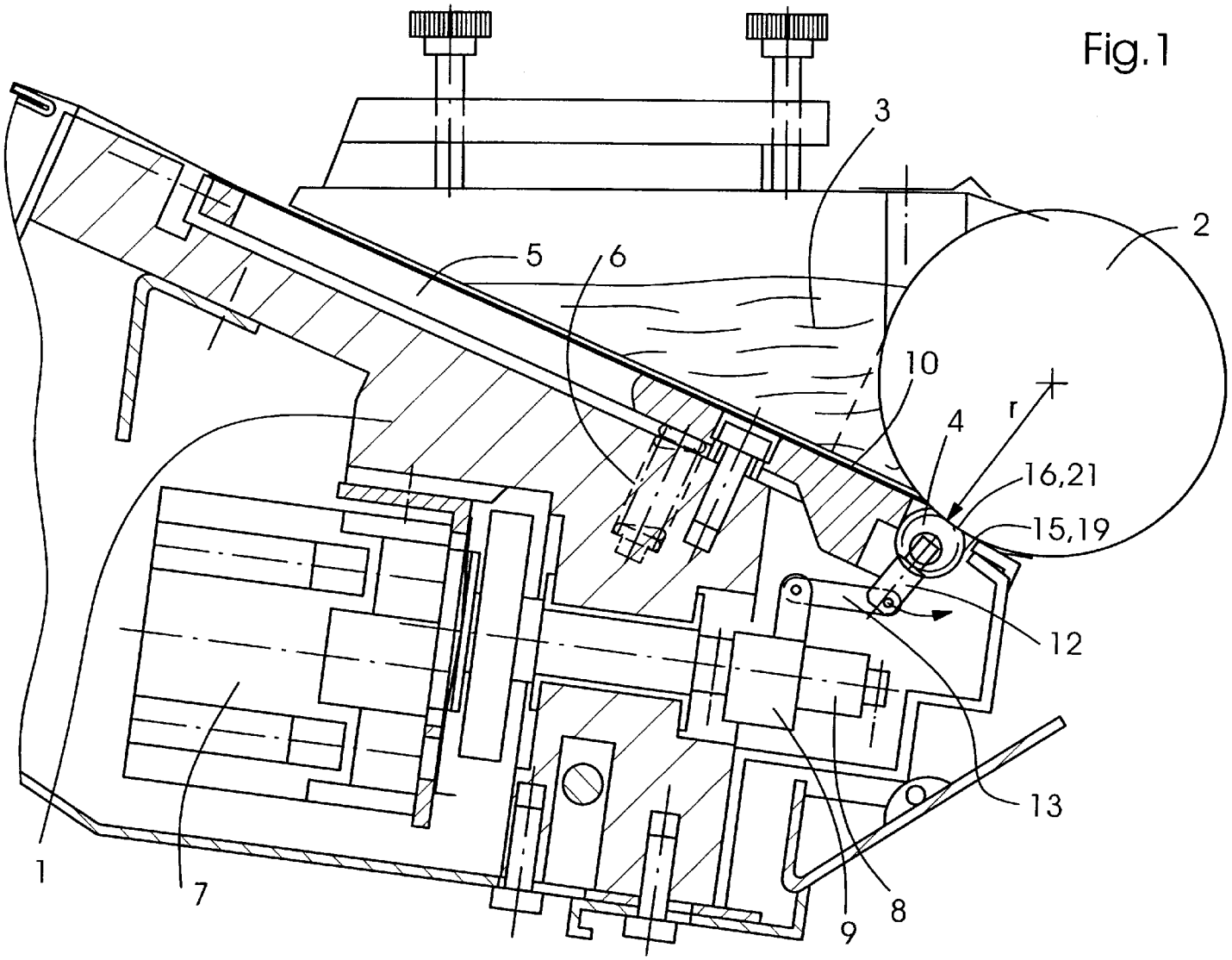
FIG. 1 is a diagrammatic cross-sectional view of an ink duct with an ink duct cylinder.

Referring now to the figures of the drawings and first particularly to FIG. 1 thereof, there is shown therein an ink duct 1 associated in a heretofore known manner with an ink duct cylinder 2 for accepting ink 3 thereon. As shown in FIG. 1, zone-wide metering elements 4 are held by guides 5, which are so braced by compression springs 6 as to press the metering elements 4 against the outer cylindrical or jacket surface of the ink duct cylinder 2. The metering elements 4 can be pivoted via a drive 7, threaded spindles 8, and adjusting bodies 9. For protecting the metering elements 4, they and the guides 5 can be covered with an elastic foil or film 10.

Figure 2:
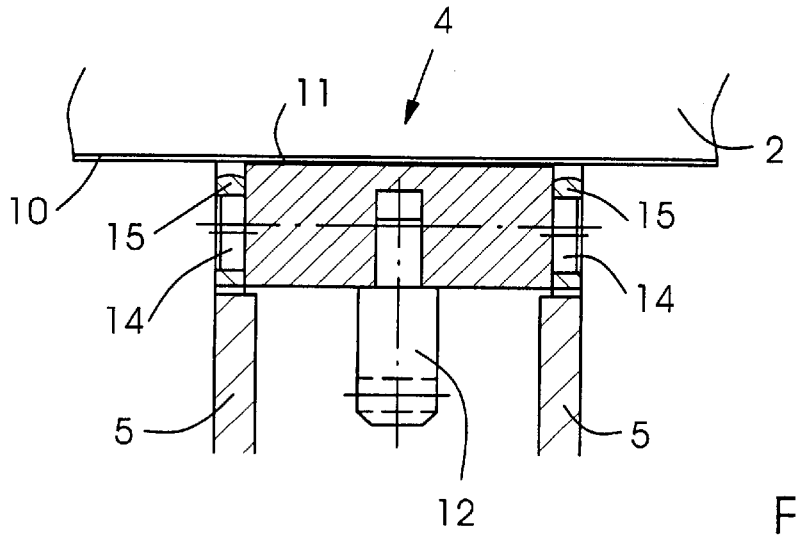
FIG. 2 is a fragmentary longitudinal sectional view of FIG. 1 taken through a metering element with support rings.
Figure 3:
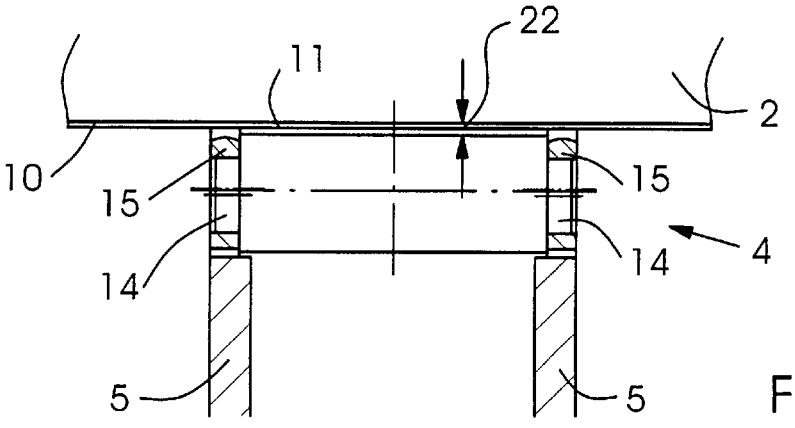
FIG. 3 is a view like that of FIG. 2 showing a different operating phase of the metering element.
Figure 4:
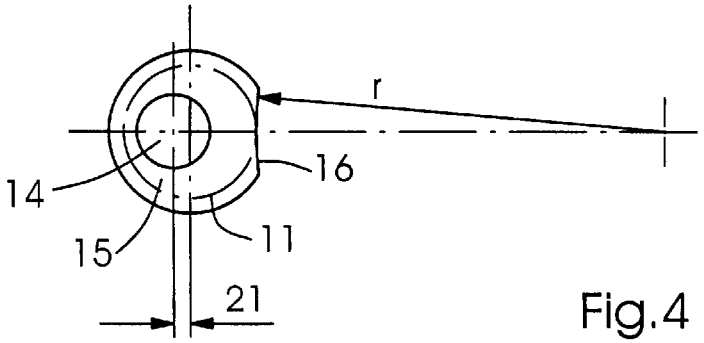
FIG. 4 is an enlarged diagrammatic side view of a support ring for the metering element.

As shown in FIG. 2, the metering elements 4 have a cylindrical metering region 11 on which an arm 12 is provided for swiveling or pivoting the respective metering element 4. The arm 12 is connected to the adjusting body 9 via a connecting rod 13. In the embodiments of FIGS. 2 to 4, journals 14 are provided on the metering element 4 at both sides of the metering region 11, and support rings or collars 15 are rotatably mounted on the journals 14. The support rings 15 are formed with flattened surface portions 16, with which they rest through the intermediary of the foil or film 10 on the jacket surface of the ink duct cylinder 2. As is apparent from FIG. 4, the journals 14 are eccentrically offset from the metering region 11, and the bores in the support rings 15 are also eccentrically offset, so that the respective flattened surface portion 16 corresponds or coincides with the greatest eccentricity of the metering region 11. This position is shown in FIG. 2, the metering region 11 being closed to the jacket surface of the ink duct cylinder 2 and not forming any ink gap. In FIG. 3, the metering element 4 is shown pivoted or swiveled so that the metering region 11 is spaced a distance corresponding or equivalent to the ink gap away from the jacket surface of the ink duct cylinder 2. The flattened surface portion 16 of the support rings 15 thus overhangs or protrudes. In this regard, the support rings 15 are pressed against the jacket surface of the ink duct cylinder 2 via the guide 5 and the compression springs 6.

Figure 5:
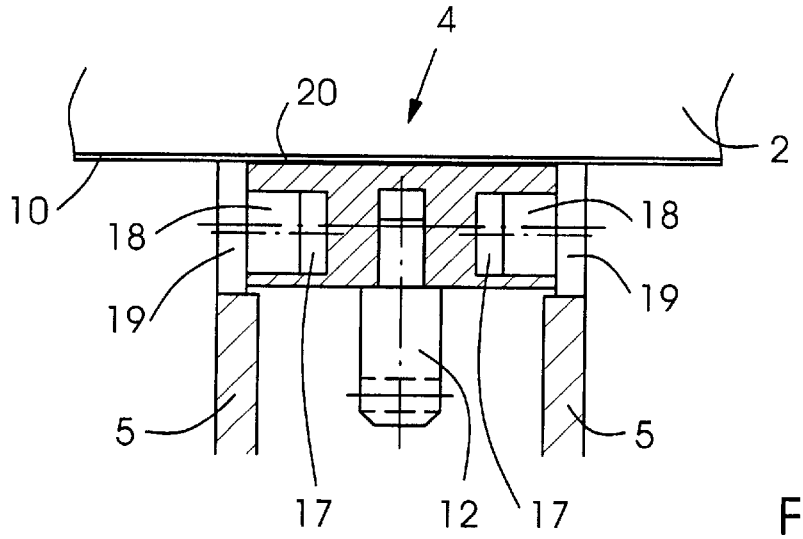
FIG. 5 is a view like that of FIG. 2 taken through a metering element with support bodies other than the support rings.
Figure 6:
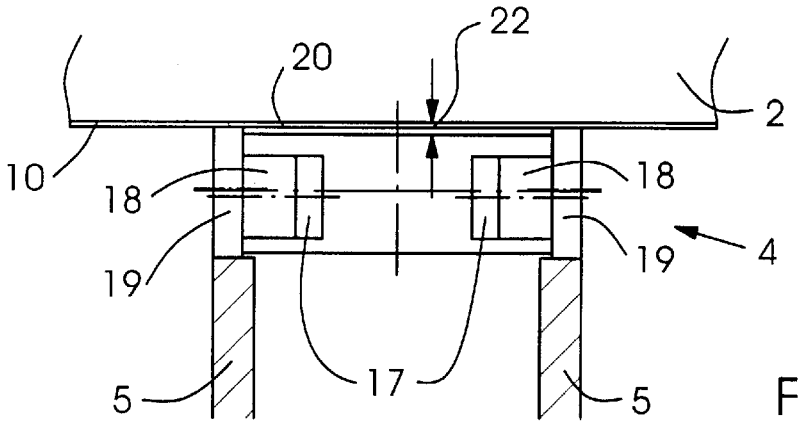
FIG. 6 is a view like that of FIG. 5 showing a different operating phase of the metering element with the support bodies.
Figure 7:
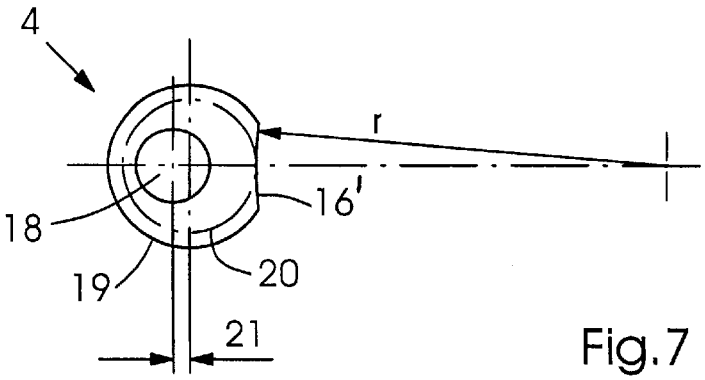
FIG. 7 is an enlarged diagrammatic side view of one of the support bodies for the metering element.

In FIGS. 5 to 7, metering elements 4 are shown provided with bores 17 formed at both sides thereof into which pins or trunnions 18 of support bodies 19 are inserted. In this embodiment also, the metering regions 20 are of cylindrical shape, so that, when swiveled or pivoted, they extend in a wedgelike manner. To that end, the bores 17 and the pins 18 are offset eccentrically to the metering region 20, so that when the metering element 4 is rotated, the gap between it and the jacket surface of the ink duct cylinder 2 can be suitably adjusted. The support bodies 19 likewise have a flattened surface portion 16', which rests on the ink duct cylinder 2 via the foil or film 10. FIG. 5 shows the metering region 20 in a closed state, and FIG. 6 shows a gap between the metering region 20 and the jacket surface of the ink duct cylinder 2, the gap being formed by rotation of the metering element 4. The eccentricity 21 of the respective journal 14 and the bore 17 with the pin 18 is selected to suit the desired maximum gap thickness 22 between the metering region 11, 20 and the jacket surface of the ink duct cylinder 2.

In an advantageous construction of the invention, the flattened surface portion 16, 21 on the support bodies 15, 19 may have an inner radius r which corresponds approximately to the radius of the jacket surface of the ink duct cylinder 2.

Figure 8:
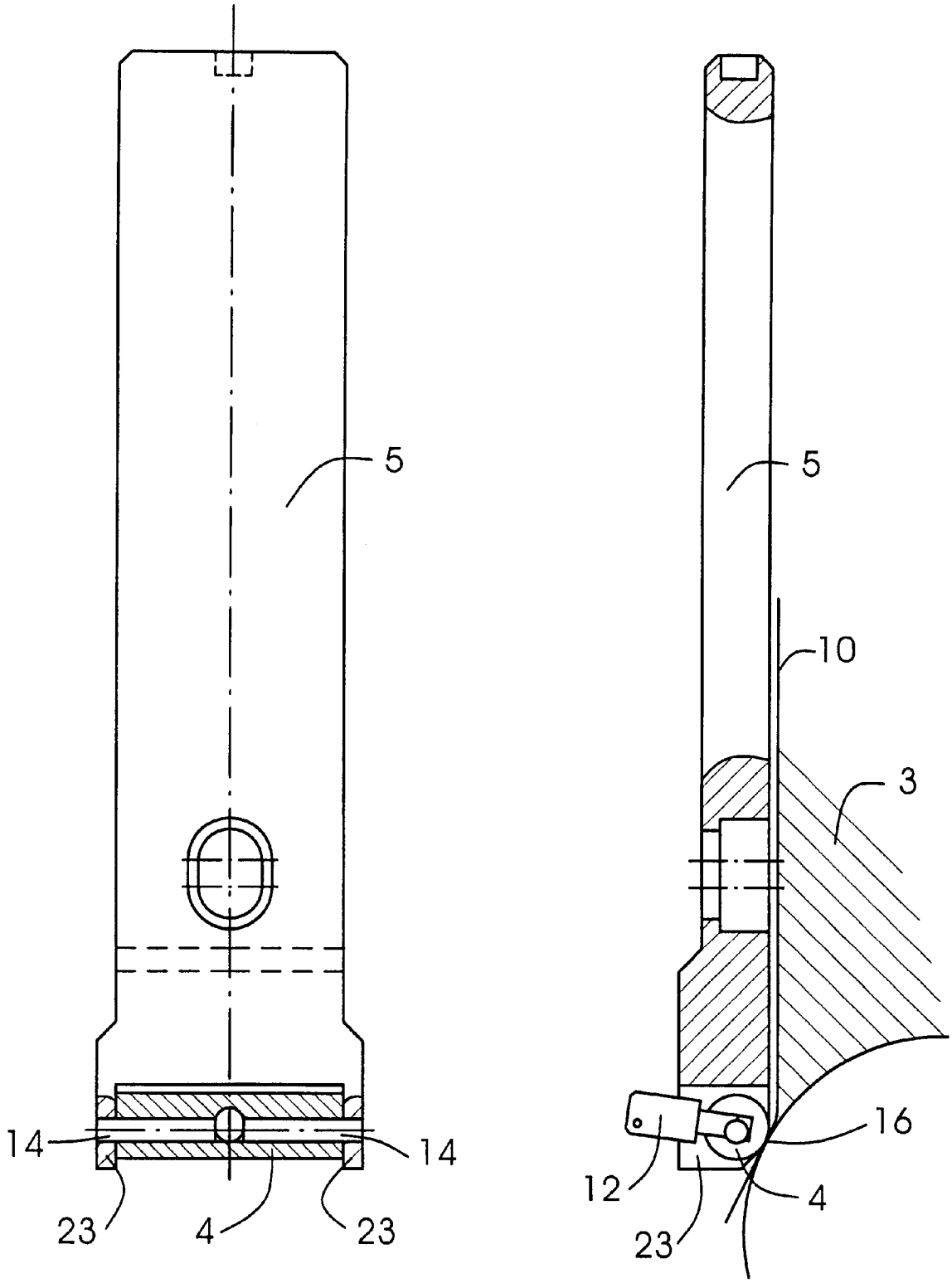
FIG. 8 is a sectional view of a guide having a bifurcated or fork-shaped construction in the region of the metering elements.

FIG. 8 shows a guide 5 having a bifurcated or fork-shaped construction in the region of the metering elements 4, the bifurcated guide 5 receiving between the tines or ends 23 thereof a respective metering element 4 via eccentrically disposed journals 14. Flattened surface portions 16 formed on the tines or ends 23 rest directly or indirectly via the foil or film 10, under spring pressure, on the outer cylindrical or jacket surface of the ink duct cylinder 2.

We claim:

1. An ink duct for rotary printing presses with zone-wide metering elements disposed side by side and adjustable a variable spaced distance from an ink duct cylinder, each of the metering elements having support and metering regions disposed in the axial direction of the ink duct cylinder, the support regions resting independently of one another, under spring pressure, at least indirectly on the ink duct cylinder, and the metering regions extending in a wedgelike manner, the metering elements being swivelably supported and being coverable by an elastic foil secured to the ink duct, comprising support bodies disposed on the metering elements at both sides of the metering regions, the metering regions being cylindrical and being formed on the metering elements; said support bodies having a circumference formed with a flattened contact surface portion by which said support bodies at least indirectly rest, under the spring pressure, on a jacket surface of the ink duct cylinder.

2. The ink duct according to claim 1, including an eccentically offset swivel location for said support bodies on the metering elements.

3. The ink duct according to claim 1, wherein said support bodies are embodied as support rings disposed on eccentrically offset journals at both sides of the metering elements.

4. The ink duct according to claim 1, wherein said support bodies have eccentrically offset pins by which they are swivelably supported in eccentrically offset bores formed in the metering elements.

5. The ink duct according to claim 1, wherein the flattened surface portions on said support bodies have an inner radius r approximately corresponding to the radius of the jacket surface of the ink duct cylinder.

6. The ink duct according to claim 1, including guides for holding the metering elements, said guides being formed as said support bodies and being bifurcated for receiving the metering elements between bifurcated ends thereof, said bifurcated ends being formed with flat surfaces.

* * * * *